US005523048A

United States Patent [19]

Stinson et al.

[11] Patent Number: 5,523,048

[45] Date of Patent: Jun. 4, 1996

[54] METHOD FOR PRODUCING HIGH DENSITY REFRACTORY METAL WARHEAD LINERS FROM SINGLE PHASE MATERIALS

[75] Inventors: Jonathan S. Stinson, Plymouth; Stanley R. Nelson, Minneapolis; Craig L. Wittman, Golden Valley, all of Minn.

[73] Assignee: Alliant Techsystems Inc., Hopkins, Minn.

[21] Appl. No.: 282,345

[22] Filed: Jul. 29, 1994

[51] Int. Cl.[6] ..... B22F 3/16

[52] U.S. Cl. ..... 419/28; 419/38; 419/42; 419/48; 427/446; 427/248.1

[58] Field of Search ..... 419/28, 38, 42, 419/48; 427/446, 248.1

[56] References Cited

U.S. PATENT DOCUMENTS

| | | | |
|---|---|---|---|
| 3,888,636 | 6/1975 | Sczerzenie et al. | 29/182 |
| 4,981,512 | 1/1991 | Kapoor | 75/248 |
| 5,000,093 | 3/1991 | Rozner et al. | 102/364 |
| 5,119,729 | 6/1992 | Nguyen | 102/307 |
| 5,126,105 | 6/1992 | Runkle et al. | 419/30 |
| 5,166,471 | 11/1992 | Maselli et al. | 102/496 |
| 5,227,576 | 7/1993 | Howard | 86/1.1 |
| 5,251,530 | 10/1993 | Kaeser | 86/20.14 |

*Primary Examiner*—Donald P. Walsh
*Assistant Examiner*—Daniel J. Jenkins
*Attorney, Agent, or Firm*—Leone & Moffa

[57] ABSTRACT

A process for producing high density refractory metal warhead liners from near net shape blanks. A shaped mold is filled with pure or solid solution molybdenum or tungsten powders. The powders may be isostatically pressed and sintered to form a near net shape blank. A hot isostatic press may be used in combination with these steps or by itself to form the near net shape blank. The hot isostatic press densifies the near net shape blank to at least 90% of theoretical density. Where wrought properties are desired, a final forging step is performed. Alternatively, a process such as vacuum plasma spraying may be used to form the near net shape blank. A hot isostatic press densifies the near net shape blank. A final machining step achieves a finished refractory metal warhead liner.

14 Claims, 5 Drawing Sheets

METHOD FOR PRODUCING HIGH DENSITY REFRACTORY METAL WARHEAD LINERS FROM SINGLE PHASE MATERIALS

FIELD OF THE INVENTION

The present invention relates to an improved method for producing warhead liners, more particularly a method for producing metal warhead liners from near net shape blanks formed from single phase molybdenum, tungsten or solid solution powders using hot pressing.

BACKGROUND OF THE INVENTION

Current production methods involve multiple and costly pressing, sintering, and warm forging operations to form warhead liners from substantially pure or solid solution tungsten or molybdenum powders. This process may take from 12 to 16 weeks to complete a forged and machined liner. Elimination of many of these operations may allow for lower cost and faster response to production orders.

Forging methods include U.S. Pat. No. 4,981,512 entitled METHODS ARE [sic] PRODUCING COMPOSITE MATERIALS OF METAL MATRIX CONTAINING TUNGSTEN GRAIN issued Jan. 1, 1991 to Kapoor. Kapoor discloses a composite material comprising a metal matrix of tungsten grain produced from tungsten powders formed by plasma rapid solidification. The powders are formed into a sintered preform which is consolidated to full density by either hot isostatic pressing, rapid omnidirectional compaction or hot extrusion.

The prior art also includes U.S. Pat. No. 5,000,093 entitled WARHEAD CASING issued Mar. 19, 1991 to Rozner et al. Rozner et al. discloses isostatically pressing a powder mixture to form a preform of an appropriate shape having a density of about 20% to 40% of the theoretical density, and heating the preform in an inert atmosphere at a temperature from 350° C. to 425° C. until the density reaches 60% to 70% of the theoretical density. Rozner et al. does not show a further forging step after the accomplishment of 60% to 70% of the theoretical density through sintering. Rozner et al. also does not show the use of hot isostatic pressing to achieve a greater density.

U.S. Pat. No. 5,119,729 entitled PROCESS FOR PRODUCING A HOLLOW CHARGE WITH A METALLIC LINING issued Jun. 9, 1992 to Nguyen discloses a process for atomizing at least one metal and mixing the resultant metal powder in a broad particle size distribution. The mixture is used to fill in the inner space of a double-walled container of the approximate uniform wall thickness of the lining. This space and the mixture are flushed with hydrogen and sealed in the double walled container in a gas-type manner, and a hot isostatic press is used to form a pressure-molded component. The resulting form of the component may be precise with respect to shape dimensions. The final form of the metallic lining is achieved by machining the pressure molded component.

Such conventional forging methods do not include the use of near net shaping to form warhead liners from substantially pure or solid solution alloys of tungsten or molybdenum. According to current practice, a number of forging steps are believed to be needed to provide for acceptable warhead performance. For the first time, the current invention exploits the fact that hot pressing may yield fine equiaxed grains for uniform properties and consistent performance. It is therefore a motivation of the invention to provide for a process using near net shape blanks and hot pressing to produce warhead liners.

The present invention employs a process of near net shaping of blanks formed from single phase molybdenum and tungsten powders by hot pressing isostatically or dynamically followed by a final forging step after the near net shaping. This process reduces the number of operations needed to complete a liner. Preheating and upset forging steps may be completely eliminated. Forging operations may be eliminated for liner applications where wrought properties are not needed. In addition, the present invention allows control of forging strain distribution in the material.

It is therefore one object of the invention to provide a process for providing near net shape blanks for producing high density refractory metal warhead liners.

It is another object of the invention to reduce the number of steps needed to produce a high density refractory metal warhead liner.

It is yet a further object of the invention to reduce the amount of material necessary to produce high density warhead liners by employing near net shape blanks.

It is yet a further object of the invention to provide for a high density refractory metal warhead liner having wrought properties by using a hot isostatic press with a final forging step on the near net shape blanks.

Other objects, features and advantages of the present invention will become apparent to those skilled in the art through the description of the preferred embodiment, claims and drawings herein wherein like numerals refer to like elements.

SUMMARY OF THE INVENTION

The invention provides a process for producing high density refractory metal warhead liners from near net shape blanks. A shaped mold is filled with pure or solid solution molybdenum or tungsten powders. The molybdenum or tungsten powders may be isostatically pressed and sintered to form a near net shape blank. A hot isostatic press may be used in combination with these steps or by itself to provide the near net shape blank. The hot isostatic press densifies the near net shape blank to at least 90% of theoretical density. Where wrought properties are desired, a final forging step may be performed. Alternatively, a process such as vacuum plasma spraying may be used to make structural deposits on a mandrel. A hot isostatic press forms the deposit into a near net shape blank of high density. A final machining step provides a finished refractory metal warhead liner.

BRIEF DESCRIPTION OF THE DRAWINGS

To illustrate this invention, a preferred embodiment will be described herein with reference to the accompanying drawings.

DETAILED DESCRIPTION OF THE PREFERRED EMBODIMENT

Figure 1:
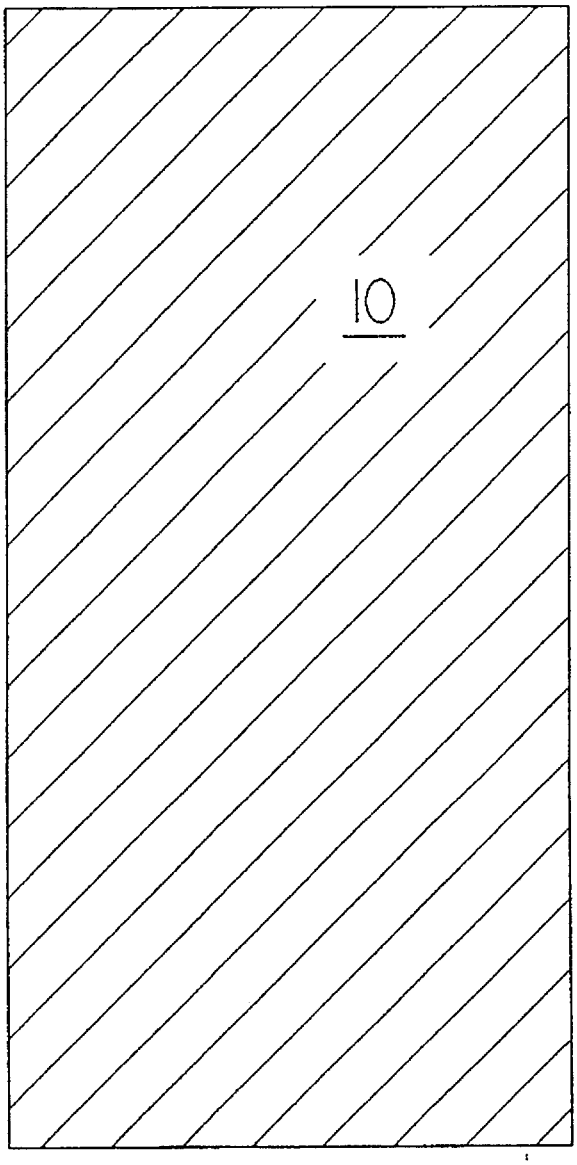
Fig. 1 (Prior Art)
FIG. 1 shows an example of the cylindrical bar blanks used in current forging operations to form warhead liners.
Figure 2:
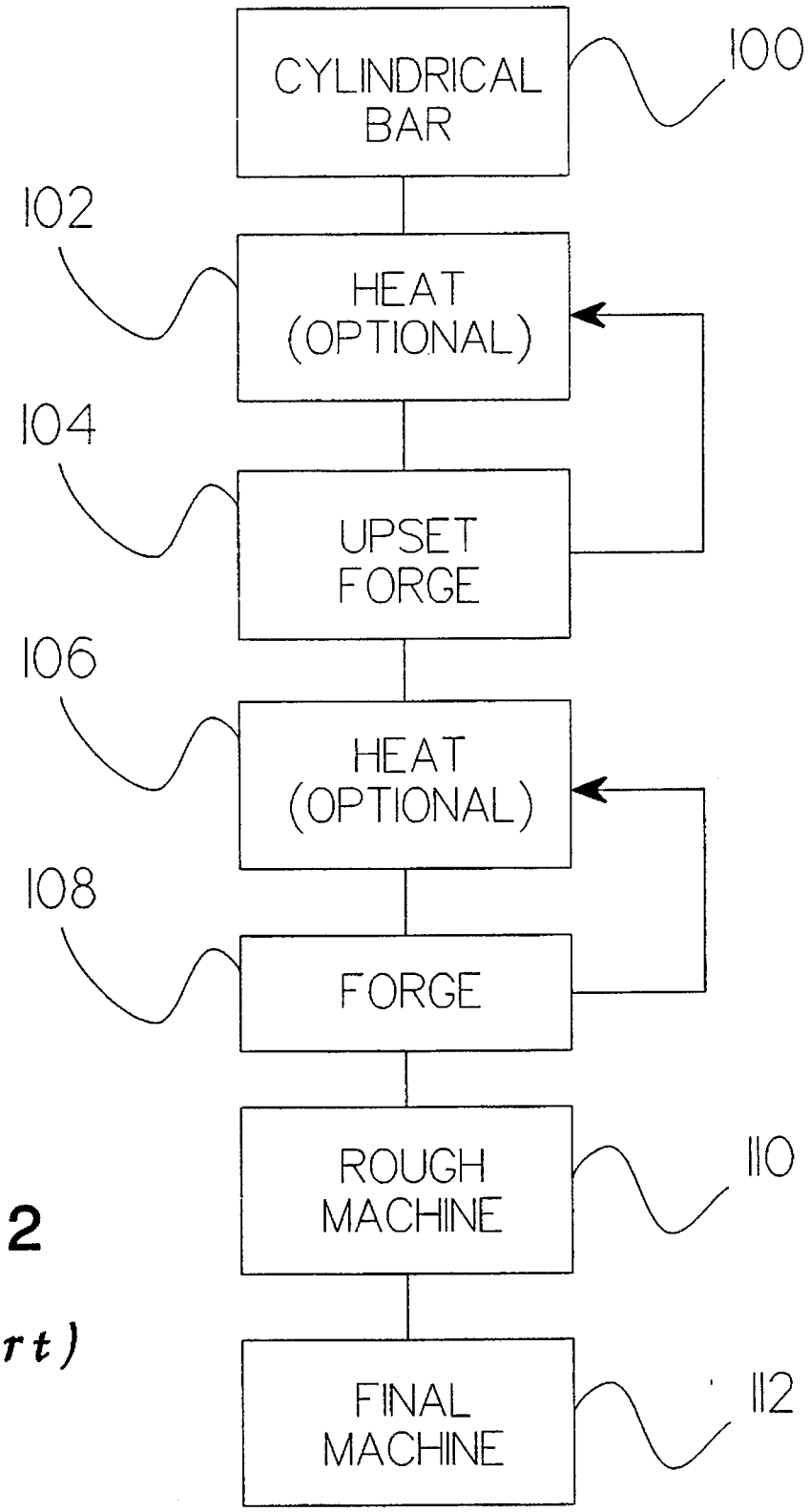
Fig. 2 (Prior Art)
FIG. 2 shows a flow diagram of a prior art process of forging refractory metal warhead liners.

FIG. 1 shows an example of the solid cylindrical bar blank 10 shape used in production methods to form warhead liners. The warhead liners may be fabricated from substantially pure or solid solution tungsten and molybdenum powders. Current methods of forming warhead liners included many forging strikes as illustrated in FIG. 2. FIG. 2 shows a flow diagram of a prior art process of forging refractory metal warhead liners. In step 100, a cylindrical bar 10 is provided. The cylindrical bar 10 may be formed by a process well known in the art, such as pressing and sintering, forging or casting. The cylindrical bar blank 10 may optionally be heated in step 102, and upset forged in step 104. These two steps are repeated until a solid liner form is achieved. The liner form then may be optionally heated in step 106 and forged in step 108. These two steps are repeated until a hollow liner shape configuration is achieved. The heating steps 102, 106 and the forging steps 104, 108 may require many costly strikes to achieve the liner shape configuration. After liner shape configuration is achieved, the liner may be rough machined in step 110. Final machining of the liner shape configuration takes place in step 112 to form a warhead liner.

Figure 3:
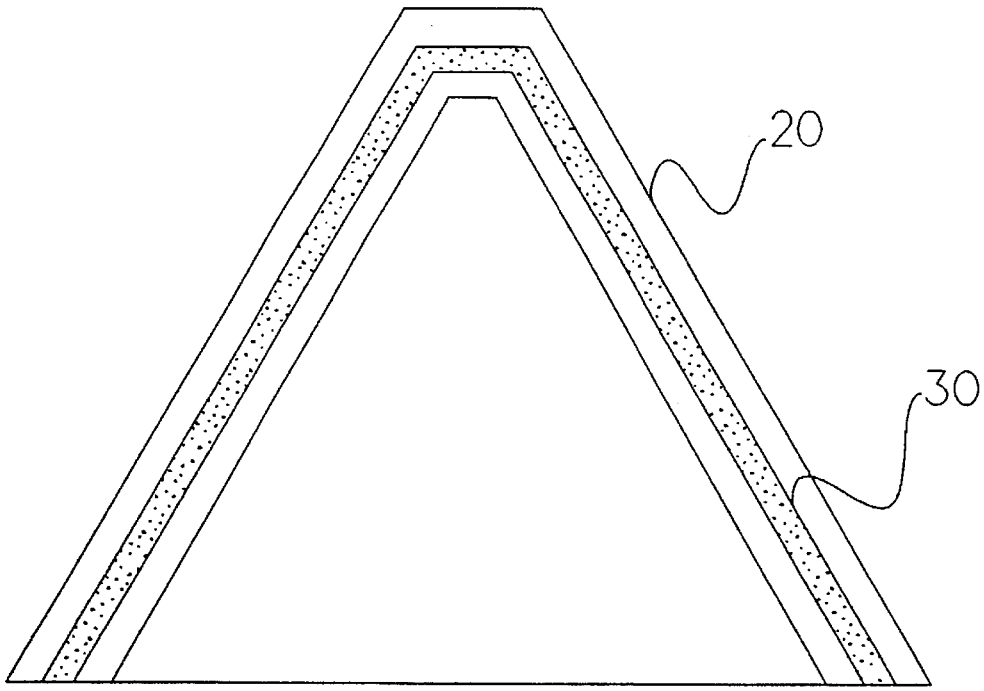
FIG. 3 shows an example of the hollow conical blanks provided by the present invention.

The present invention provides for warm or hot forging of hollow conical blanks 20 using single phase tungsten or molybdenum powders. FIG. 3 illustrates one example of the hollow conical blank 20 provided by the invention. The hollow conical blank 20 may comprise pure or solid solution alloys of tungsten or molybdenum. The hollow conical blanks 20 may be produced by cold isostatic pressing plus sintering and/or hot isostatic pressing on single phase molybdenum or tungsten allow powders. The hollow conical blank 20 has near net shape compared to a finished liner 30. The hollow conical blank 20 may be preheated and forged to the warhead liner configuration. The shape of the hollow conical blank 20 may be designed to cause a predetermined strain distribution during forging, and grain size/distribution and mechanical properties are optimized and tailored for the specific liner application. In warhead liner applications where wrought properties are not needed, finished liners may be machined directly from the hollow conical blanks 20.

Figure 4:
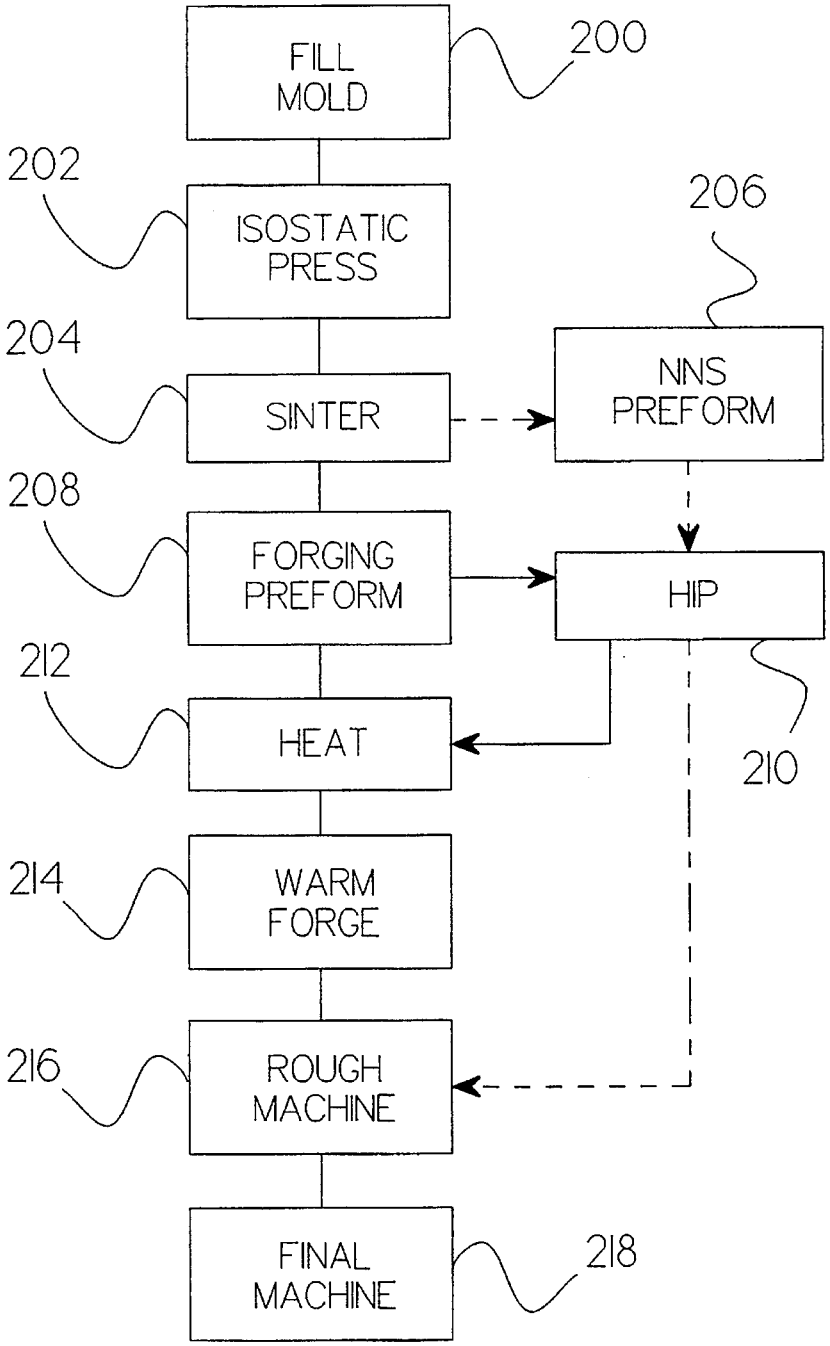
FIG. 4 shows a flow diagram of a process of forging refractory metal warhead liners.

Now referring to FIG. 4 which shows a flow diagram of a process of forging refractory metal warhead liners. In step 200, a mold is filled with pure tungsten, pure molybdenum or solid solution alloy powders. The purity of these powders may be over 99.9%. In one preferred embodiment, the mold may comprise a conical shaped metal can and shapes the powders into the form of a hollow conical blank. In step 202, the powders are subjected to an isostatic press to form a compact that is sintered in step 204. In step 208, a forging preform operation is performed on the conical blank to provide a warhead liner configuration.

In an alternate embodiment a near net shape preform may be provided in step 206. The near net shape preform may be formed by vacuum plasma spraying metal powder to make structural deposits. In one example embodiment, the metal powder may be vacuum plasma sprayed onto conical shaped mandrels to form the preform. A hot isostatic press is used in step 210 to bring the preform to substantially full density and provide a near net shape blank. These near net shape blanks may have a density greater than 95% of theoretical crystal density. The near net shape blank is heated in step 212 and a single warm forge operation takes place in step 214 to create a warhead liner. The liner is rough machined in step 216. A final machining step 218 completes the forging operation on the warhead liner.

In another preferred embodiment, after using a hot isostatic press in step 210, the near net shape blank may be machined to final warhead liner configuration in step 218 when wrought properties are not needed.

Conventional refractory metal liner fabrication involves pressing and sintering solid cylindrical bar blanks, many preheating/forging operations, and finish machining. The forging must be preheated to at least 1000° F. before each hit. A liner typically is forged in one to four upset operations and three to twelve extrusion/coining operations.

The elimination of the multiple forging strikes is illustrated in table I below. Table I shows the number of typical forging operations for the current method used to produce warhead liners, and the number of forging operations used with the present invention.

TABLE I

| Current Method | Embodiment I | Embodiment II |
|---|---|---|
| solid cylindrical bar blank | hollow conical blank | hollow conical blank |
| preheat | preheat | hot isostatic press |
| upset forge | extrude forge | |
| preheat | | |
| extrude forge | | |
| preheat | | |
| extrude forge | | |
| preheat | | |
| extrude forge | | |

As shown in Table I, the upset forging steps may be completely eliminated, and the number of extrude forging steps may be reduced or eliminated.

Figure 5:
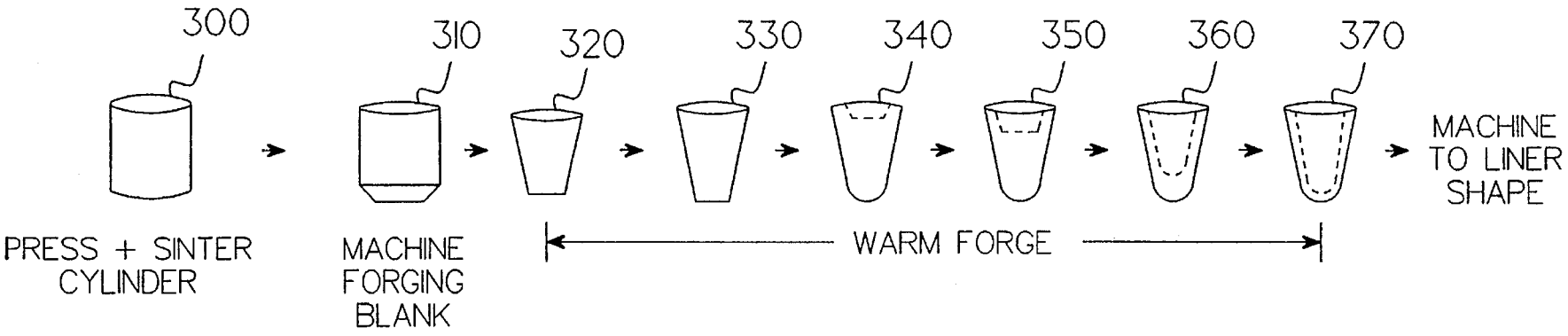
FIG. 5 shows an illustration of the forging steps used in the prior art to achieve a warhead liner.

FIG. 5 shows an illustration of the forging steps used in the prior art to achieve a warhead liner. The current method employs a cylindrical blank 300 produced from pressing and sintering. A forging blank 310 is machined from the cylindrical blank 300. Upset and extrude forges are performed to provide forging blanks 320, 330, 340, 350, 360. The warm forges are performed until a warhead liner configuration 370 is achieved. The warhead liner configuration is then machined to a final liner shape.

Figure 6:
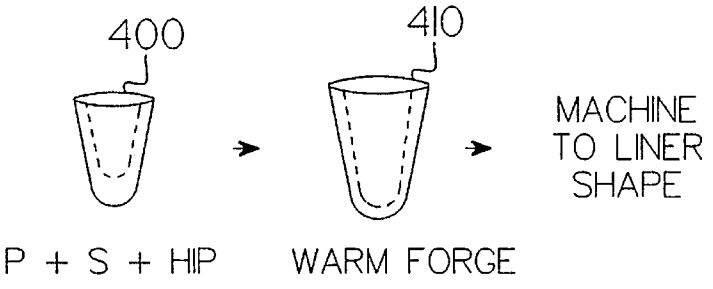
FIG. 6 shows a process for forming a warhead liner of the present invention.

FIG. 6 shows a process for forming a warhead liner of the present invention. The present invention employs either pressing and sintering and/or hot isostatic pressing to provide a solid or conical blank 400. Because the blank is designed to be a near net shape of a warhead liner, one or few strikes are needed to achieve a warhead liner configuration. The warhead liner configuration may then be machined to the final liner shape.

Figure 7:
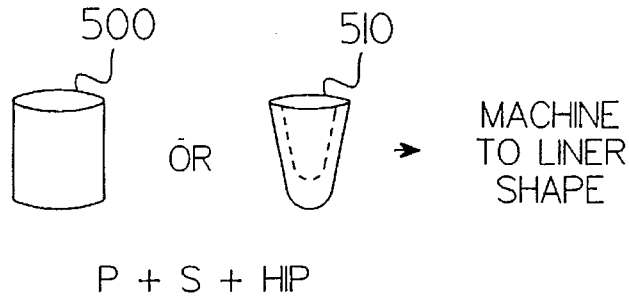
FIG. 7 shows an alternate process for forming a warhead liner of the present invention.

FIG. 7 shows an alternate process for forming a warhead liner of the present invention. In certain applications, such as low launch load applications, wrought properties may not be needed. In these cases, either pressing and sintering or hot isostatic pressing may be used to provide a solid blank 500 or conical blank 510. These blanks 500, 510 may also be designed to be a near net shape of a warhead liner. The blanks 500, 510 may be used as formed, or be machined into a final liner shape, requiring no forging operations.

The invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A process for producing high density metal warhead liners comprising the steps of:

(a) providing a shaped mold;

(b) filling the shaped mold with only pure single phase molybdenum powder or only pure single phase tungsten powder;

(c) isostatically pressing only the pure single phase molybdenum powder or only the pure single phase tungsten powder to produce compacted powder; and (d) sintering the compacted powder to form a near net shape blank.

2. The process of claim 1 wherein the shaped mold comprises a conical shaped mold.

3. The process of claim 1 wherein the single phase molybdenum powder or single phase tungsten powder comprises pure molybdenum powder, solid solution molybdenum powder, pure tungsten powder or solid solution tungsten powder.

4. The process of claim 1 wherein step (c), isostatically pressing the single phase molybdenum powder or single phase tungsten powder, comprises the step of using a hot isostatic press to compact the single phase molybdenum powder or single phase tungsten powder to at least 90% of theoretical density.

5. The process of claim 1 further comprising the steps of:

(e) heating the near net shape blank;

(f) warm forging the near net shape blank to provide a metal warhead liner; and (g) repeating step (f) until a warhead liner configuration is achieved.

6. The process of claim 5 wherein step (f), warm forging the near net shape blank, is performed only once.

7. A process for producing high density metal warhead liners comprising the steps of:

(a) providing a near net shape preform comprising only pure single phase molybdenum powder or only pure single phase tungsten powder;

(b) performing a hot isostatic press on the near net shape preform to form a near net shape blank;

(c) performing a final forging step on the near net shape blank to provide a metal warhead liner; and (d) repeating step (c) until a warhead liner configuration is made.

8. The process of claim 7 wherein the single phase molybdenum powder, single phase tungsten powder comprise pure molybdenum powder, solid solution molybdenum powder, pure tungsten powder or solid solution tungsten powder.

9. The process of claim 7 wherein step (a), providing a near net shape preform, comprises the step of depositing single phase molybdenum or tungsten powders on a mandrel to form structural deposits to provide a near net shape preform.

10. The process of claim 9 wherein the step of depositing single phase molybdenum or tungsten powders on a mandrel comprises vacuum plasma spraying single phase molybdenum or tungsten powders onto the mandrel.

11. The process of claim 9 wherein the step of depositing single phase molybdenum or tungsten powders on the mandrel comprises using chemical vapor deposition to deposit single phase molybdenum or tungsten powders onto the mandrel.

12. The process of claim 7 wherein step (a), providing a near net shape preform, further comprises the step of injecting single phase molybdenum powder or single phase tungsten powder into a mold to provide a near net shape preform.

13. The process of claim 7 wherein step (b), performing a hot isostatic press, compacts the near net shape blank to at least 90% of theoretical density.

14. The process of claim 7 wherein step (c), performing a final forging step, comprises the steps of heating the near net shape blank; and warm forging the near net shape blank to provide a metal warhead liner.

* * * * *